US005706358A

United States Patent [19]

Ashworth

[11] Patent Number: 5,706,358

[45] Date of Patent: Jan. 6, 1998

[54] MAGNETIC AUDIO TRANSDUCER WITH HINGED ARMATURE

[76] Inventor: William J. Ashworth, 1012 Ashworth Cove, Altamonte Spgs., Fla. 32714

[21] Appl. No.: 635,639

[22] Filed: Jul. 26, 1996

[51] Int. Cl.[6] ..... H04R 25/00

[52] U.S. Cl. ..... 381/152; 381/188

[58] Field of Search ..... 381/152, 156, 381/160, 188, 189, 192, 194, 198, 199, 205; 181/179, 150

[56] References Cited

U.S. PATENT DOCUMENTS

| | | | |
|---|---|---|---|
| 3,449,531 | 6/1969 | Ashworth | 381/152 |
| 3,509,282 | 4/1970 | Ashworth | 381/152 |
| 3,609,253 | 9/1971 | Ashworth | 381/152 |
| 3,728,497 | 4/1973 | Komatsu | 381/152 |
| 3,848,090 | 11/1974 | Walker | 381/152 |
| 3,925,627 | 12/1975 | Ashworth | 381/162 |
| 4,064,376 | 12/1977 | Yamada | 381/152 |
| 4,151,379 | 4/1979 | Ashworth | 381/195 |
| 4,914,750 | 4/1990 | Lawson | 381/188 |
| 5,058,173 | 10/1991 | Ashworth | 381/152 |
| 5,287,413 | 2/1994 | Ashworth | 381/152 |
| 5,335,284 | 8/1994 | Lemmons | 381/152 |
| 5,400,412 | 3/1995 | King, Sr. et al. | 381/152 |

*Primary Examiner*—Curtis Kuntz
*Assistant Examiner*—Rexford N. Barnie

[57] ABSTRACT

A sound transducer or reproductive system has a radiating flexible diaphragm which is attached to a sound radiating board, for example, walls, doors, car body, etc., causing the sounding board to radiate sound. The electromagnetic circuit/driving member is resiliently attached to an armature so that the armature and its driving members react to create motion and also, produce good quality low frequency response or bass tones as well as mid-range and high frequency response. A resilient compressible and expandable means such as pads, springs or clips with an adjustable magnetizable bumper means is interposed between the driving means and the driven means and creates an air gaps which is critical for optimum performance.

5 Claims, 2 Drawing Sheets

MAGNETIC AUDIO TRANSDUCER WITH HINGED ARMATURE

BACKGROUND OF INVENTION

1. Field of Invention

This invention relates to audio transducers and more particular to audio transducers designed to be secured to sounding boards such as walls, windows, doors or any other elements that will flex in response to received audio input signals.

2. Description of Related Art Including Information Dislcosed Under (370 CFR 1.97–1.99

U.S. Pat. No. 1,383,700 (Edgerton) discloses a transducer acoustic element designed to respond to acoustic signals propagated in air or water. The apparatus is designed to be secured to an element which will flex in response to received audio input signals.

U.S. Pat. No. 2,341,275 (Holland) describes a sound reproducing apparatus or transducer which vibrates in response to magnetic input and designed to be secured to an element or make the element provide an output. A sample output element is a glass window pane.

U.S. Pat. No. 3,666,749 (Reis) discloses an audio transducer designed to be secured to a wall to make the wall vibrate in response to the transducer output.

U.S. Pat. No. 3,430,007 (Thielen) discloses another type of audio transducer designed to be mounted to a wall. The apparatus includes a ring which contacts the wall about a screw element which is embedded in the wall. Vibrations are transmitted from the transducer to the wall through the ring element as well as through the screw.

U.S. Pat. No. 3,449,531 (Ashworth) discloses another type of transducer element securable to a wall to make the wall vibrate in response to the output of the transducer element. Several different examples are given in the patent of how the transducer apparatus may be secured to a wall.

U.S. Pat. No. 3,524,027 (Thurston et al) discloses another type of sound transducer designed to be mounted to a wall. The apparatus includes a diaphragm element which encloses electromagnetic elements. The vibrations of the diaphragm are in turn imparted through the wall.

U.S. Pat. No. 3,567,870 (Rivera) discloses another type of transducer to be mounted on a wall. The transducer includes a housing, with the electromagnetic components inside the housing, with the electromagnetic components inside the housing, and with a circular boss that is disposed against a wall. The housing is of a generally circular configuration with generally flat tops and bottoms and curved other periphery. The housing is made of two substantially identical elements connected together at their outer edges.

U.S. Pat. No. 3,861,495 discloses a transducer element designed primarily for increasing or improving base response by securing a transducer to a relative large sound receiving panel.

U.S. Pat. No. 4,514,599 (Yanagishima et al) discloses a speaker designed for an automotive vehicle. The speaker is designed to be secured to a panel to cause the panel to act as a sound producing element. Numerous embodiments are disclosed in the patent.

U.S. Pat. No. 4,951,270 (Andrews) discloses another type of sound transducer designed to be mounted to a wall. The apparatus includes a diaphragm element which encloses electromagnetic elements. The vibrations are in turn imparted thru a wall. The transducer structure also includes a separate tweeter apparatus.

U.S. Pat. No. 5,058,173 (Ashworth) discloses a transducer designed to vibrate a sound radiating panel together with propogating its own sound waves with the same transducer vibratory element.

U.S. Pat. No. 5,287,413 (Ashworth) discloses a transducer designed to receive two separate sound signals wherein the two signals are imposed on a sound radiating panel.

SUMMARY OF THE INVENTION

The invention described and claimed herein comprises an inertia type transducer for transducing electromechanical signals into an audio output. The transducer includes a magnetic assembly for securing to a semi-rigid structure such as a wall, door, window, metal surface or other like structures to cause the structure to become part of a sound radiating device in providing an audio output. The magnetic assembly includes two elements consisting of a magnetically driving portion and a magnetically driven armature portion. Both portions are secured together by a magnetic attraction and a hinged connection between the two portions. The driven portion or magnetic armature includes flanges extending outwardly from the rim of the armature and are secured against the sound radiating structure. The flanges extending outwardly at the edges of the magnetically driven cup shaped armature portion causes a sound baffling cavity to be formed between the sound radiating structure and the greater part of the magnetically driven armature portion. The vented cavity portion of the armature between the sound radiating structure and the magnetically driven armature allows the armature to react, substantially unrestricted to the treble electrical sound signals imposed on it by the driving portion of the transducer assembly because of the high natural resonance of the armature over the cavity. These treble vibrations together with the mid-range and bass vibrations are transmitted to the sound radiating structure through the flanges affixed to the sound radiating surface, as well as radiating them directly into listening area. Intense low frequency bass vibrations are generated by the transducer assembly because of the unique and novel coupling together of the driving portion of the transducer assembly. A flexible coupling member is affixed to an area of the periphery of the driving portion and to the magnetic armature portion. The armature member, may have a magnetic adjustable spacer affixed to the magnetic armature that creates an air gap between the driving portion and the driven armature. A resilient, flexible bumper spacer may be positioned between the driving portion and the driven armature instead of the adjustable spacer to form the air gap. This air gap allows the armature to vibrate as a result of the electrical magnetic impulses generated by the driving portion of the transducer. The low frequency bass electrical signals which are fed to the driving portion creates a magnetic oscillating repelling action between the driving portion and the magnetic armature portion, pushing the driving portion away from the magnetic armature as shown in FIG. 4. The driving portion is hinged to the magnetic armature by a flexible coupling but is not fastened to an adjustable spacer of the flexible, resilient bumper attached to the armature at a position substantially opposite to the flexible hinge coupling. The flexible hinged is coupled together with the driving and driven portion of the transducer assembly allowing the driving portion to oscillate with a substantially unrestricted movement. The unrestricted strong bass tone oscillations of the driving portion is transmitted to the sound radiating structure through the armature flanges attached to the sounding board. This causes strong bass tones to be radiated from the sound radiating structure. An opening is provided through the driving member to allow air to flow over and around the driver elements. The oscillations of the driving member and the driven armature elements creates a built in fan or blower to move cooling air through the opening and around the driver element. The air blown around and thru the driver portion also transmits sound waves into the listening area independently of the sound radiating structure. When mid-range tone electrical signals are impressed on the driving portion, inertia causes the driving portion to remain substantially in a fixed position. The driving portion rests against the spacer and is also attached to the resilient hinge element as shown in FIG. 1. As varying electrical signals are applied to the driving portion, the adjustable spacer serves as a fulcrum for the driving portion allowing the resilient hinge element to compress and decompress according to the magnetic oscillating force being applied to the armature secured to the sounding board. When a resilient, flexible spacer is used rather than the adjustable spacer, it will compress and decompress the same as the flexible hinge member. When treble magnetic forces are applied to the armature, the driving portion remains substantially in a static position due to inertia and the portion of the armature over its cavity vibrates. These treble vibrations are transmitted directly into the listening area and to the sounding board thru the armature flanges. The armature cavity and the hinged action of the driving portion of the transducer assembly provides a single unit that substantially reproduces the entire audio spectrum of sound. The cavity has natural resonances that are objectional to listeners when certain types of sounding boards are used. These undesirable resonances can be dampened by placing a resilient material such as sponge rubber in the cavity. It should be understood that other hinged armature configurations may be used that will produce different frequency responses. This invention may be used together with conventional paper cone speakers as shown in this disclosure and in my U.S. Pat. Nos. 3,449,531, 5,058,173 and 5,287,413 to improve the perceived sound of the conventional speaker or speakers by the listener. The playing together of the transducer and conventional speaker gives the illusion of the listener being surrounded by the sound, because of the heavier sounding board has a slower sound decay time than the lighter paper speaker cone.

Among the objects of the present invention are the following:

- To provide new and useful transducer apparatus;
- To provide new and useful transducer apparatus secured to a semi-rigid structure to cause the structure to vibrate in response to the output of the transducer;
- To provide new and used transducer for providing an audio output in response to an electrical signal input;
- To provide new and used transducer for providing a sound output separately from the sound output radiated from the sound radiating structure the transducer is affixed to;
- To provide new and useful transducer for providing air circulation for cooling transducer;
- To provide new and useful transducer to operate in combination with conventional paper cone speakers.

DESCRIPTION OF THE PREFERRED EMBODIMENT

Figure 1:
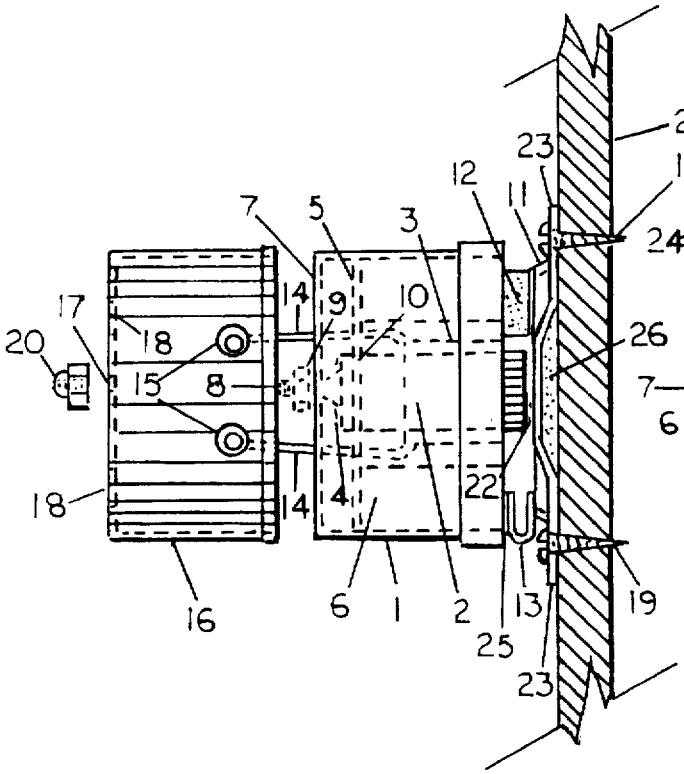
FIG. 1 is a side view of the present invention with the outer cover of the apparatus separated.
Figure 2:
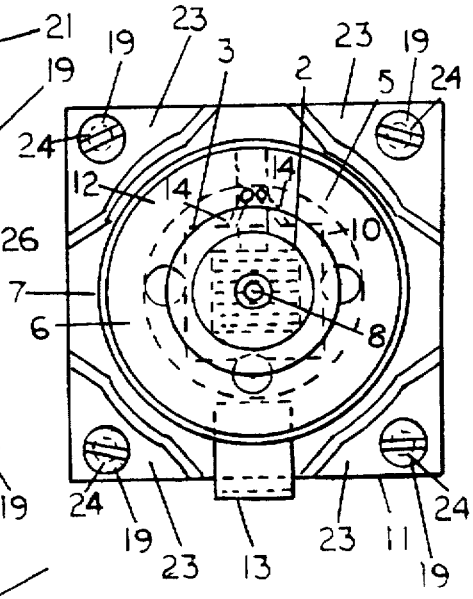
FIG. 2 is a top view of the present invention without its outer cover for better clarity.
Figure 3:
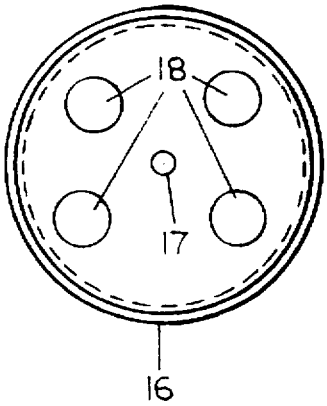
FIG. 3 is a top view of the outer cover of the present invention.
Figure 4:
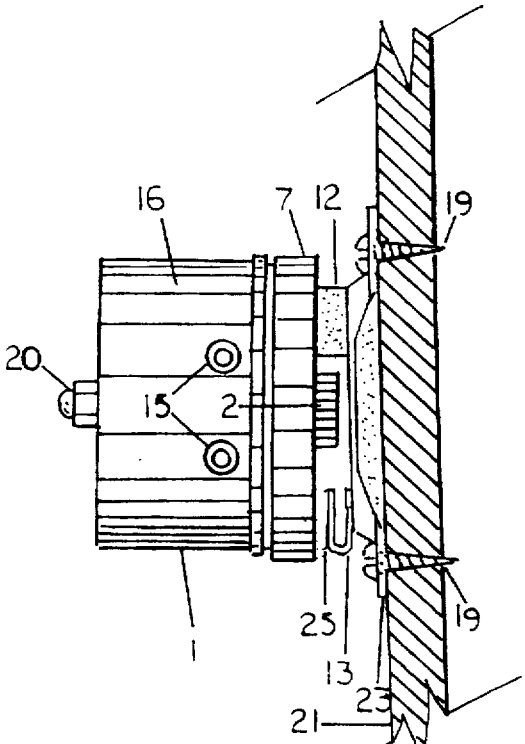
FIG. 4 is a pictorial side view of the present invention showing the hinging action of the transducer together with the outer cover of the apparatus in place.
Figure 5:
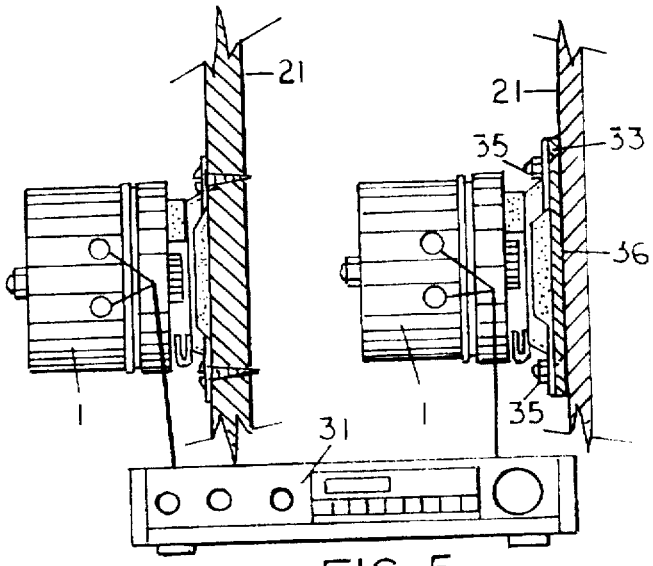
FIG. 5 is a schematic pictorial side view of one method of using the present invention.
Figure 8:
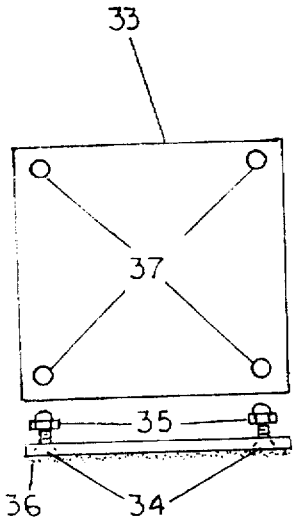
FIG. 8 is a top and end view of a mounting bracket for the present invention.
Figure 6:
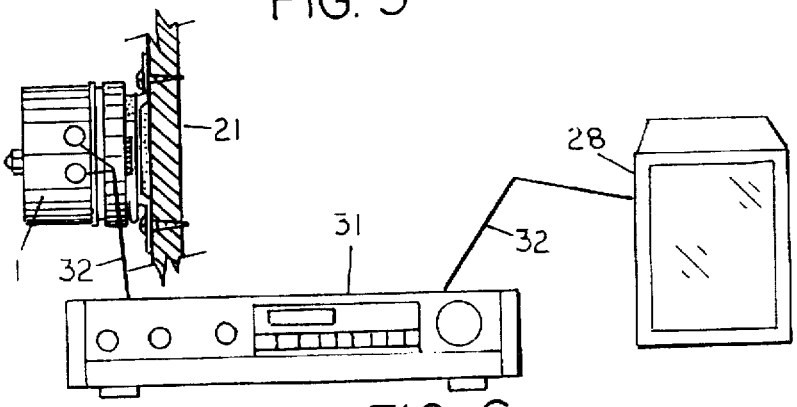
FIG. 6 is another schematic pictorial view of another method of using the present invention.
Figure 7:
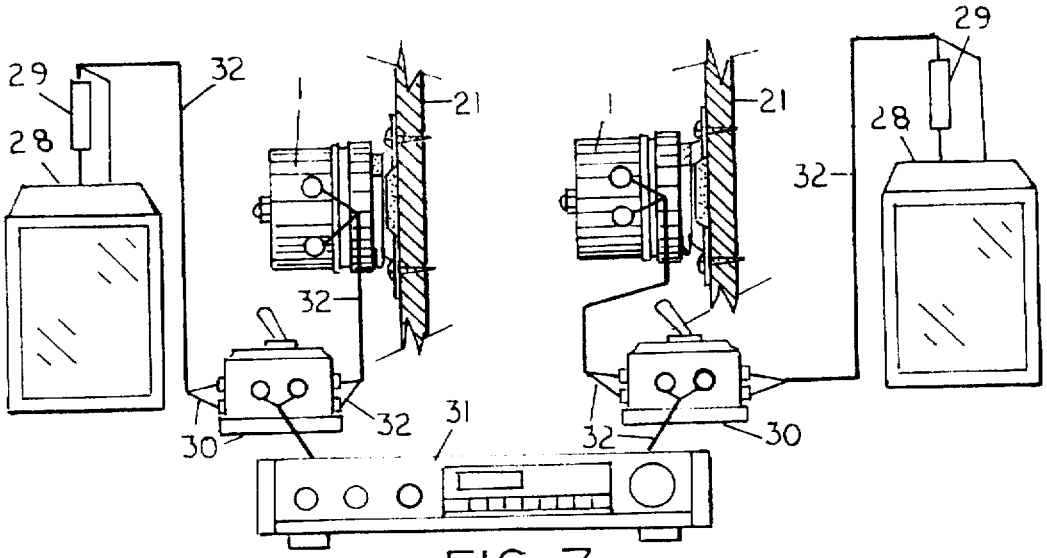
FIG. 7 is still another schematic pictorial view of still another method of using the present invention.

FIG. 1 is a side view of the preferred embodiment of the present invention. The transducer apparatus comprises a magnetic electrically activated driving assembly and a magnetically driven element that is secured to a vibratile sounding board. The driving assembly is comprised of magnetizable core 2 that may be constructed of a laminated electrical steel or from any other suitable core material such as compressed powdered iron. Core 2 may have 200 turns of No. 27 wire. Core 2 has a coil of wire 3 wound around and secured to core 2. Core 2 and coil 3 extends through an air space in magnet 6 and through plate 5 and is secured with a suitable cement 4 such as epoxy to core support plate 5. Plate 5 is secured to magnet 6 with a suitable cement such as epoxy 4. Plate 5 may be constructed from 24 gauge steel. Plate 5 has openings 27 in it to provide for the passage of air and for the passage of sound waves. The permanent magnet 6 together with core 2, coil 3 and core support plate 5 are placed and secured into a permanent magnet cover 7 that is constructed of a suitable material such as plastic, with screw 8 and spacer nut 9 extending through hole 10 in permanent magnet cover 7. Screw 8 is cemented or fastened to the end of core 2 by any suitable means such as epoxy cement 4. The driven vibratile diaphragm 11 is attached to drying assembly 1 with a flexible material such as sponge rubber 12 along a portion of periphery of magnet 6. An air gap 22 is provided between the magnetizable core 2 and armature 11. The magnetizable air gap adjusting spacer 13 is attached to diaphragm 11 by spot welding or by other suitable means. Spacer 13 is not attached to magnet 6, but is held against it only by the magnetic attraction between driving assembly 1 and the driven magnetizable diaphragm or armature 11. The adjustable spacer 13 also provides a substantially closed magnetic circuit between magnet 6 and armature 11. A thin resiliant bumper strip 25 is disposed between magnet 6 and adjustable spacer 13 to eliminate chatter noise when the driving portion 1 of the transducer is oscillating. Bumper strip 25 may be constructed from thin rubber. Air gap 22 may adjusted to the correct opening by opening or compressing spacer 13. Adjustable spacer 13 is easily accessible and can be opened with a flat screwdriver blade or closed with a pair of pliers. Spacer 13 may be a non-adjustable resilient flexible spacer bumper and located at the same place as the adjustable spacer. Coil lead wires 14 connect to lead wire terminals 15. The outer cover 16 is positioned over the driver assembly 1 with screw 8 passing thru hole 17 in outer cover 16. Capnut 20 is threaded onto screw 8 pushing cover 16 against spacer nut 9 which fastens cover 16 in place over assembly 1. The outer cover 16 has openings 18 to provide for the passage of air and sound waves and is for appearance purposes only, and the present invention would operate without it. Diaphragm or armature 11 is attached to a vibratile sounding board with screws 19. Diaphragm 11 also may have a flexible material 26 such as sponge rubber disposed in the cavity of diaphragm 11 to dampen undesired resonances generated by diaphragm 11. FIG. 5 is a pictorial schematic view that shows the present invention connected to a stereo receiver and attached to sounding boards that will take screws and also to a hard surface such as glass with a bracket 33 as shown in FIG. 8. The bracket shown in FIG. 8 is an alternative method of attaching the present invention to a sounding board and comprises of a member 33 that may be constructed of a thin flat plywood. Member 33 has counter sunk screws 34 extending thru member 33, the flat side of member 33 is attached to sounding board 21 with double faced tape 36 or with any other suitable means. When bracket 33 is secured to a sounding board, armature 11 is fastened to bracket 33 with nuts 35. FIG. 6 is a pictorial schematic view of the present invention showing transducer 1 and a conventional dynamic speaker 28 connected to a stereo set 31. FIG. 7 shows a pictorial schematic view of transducers 1 and conventional speakers 28 connected to a stereo receiver 31 playing together. Switches 30 provides a method to switch transducers in and out of the circuit to give the listener an instantaneous way to determine the great improvement in the sound when transducers 1 are playing together with the conventional speakers 28. Many attempts have been made to produce an audio transducer that will substantially produce the entire audio range and be able to compete with paper cone speaker systems. Many patents have been issued disclosing audio transducers using dynamic movable voice coil systems. This type of transducer could produce an acceptable mid-range and treble response. Because of the very rigid voice coil suspension required in this type transducer to keep the voice coil from binding, they could not resonate an acceptable bass response. Another problem with this movable voice coil transducer is the internal heat generated inside the transducer. The voice coils usually had approximately 8 ohms of heat generating internal resistance. Because of the greater amount of electrical power required to drive a heavy sounding board than to drive a light paper speaker cone, unacceptable heat is usually generated in the movable voice coil audio transducers. Most of all Ashworth patents have not used the movable voice coil dynamic concept, but used the electro-magnetic principal to overcome the above stated reasons. Prior Ashworth patents had limited diaphragm movement but had more than the movable voice coil transducers. In order to construct an audio transducer that would substantially produce the entire audio range, it had to be able to oscillate at the bass tonal range as well as the mid-range and treble tonal ranges. Such a transducer also is required to generate tones independently of the sounding board that would blend together with the tones radiated by the sounding board and produce a wide tonal range that is heard by the listener. The present invention will substantially reproduce a wide tonal range that is acceptable to most music listeners. The bass response is governed by the low resonance response of the transducer and partially by the low natural resonance of the sounding board the transducer is attached to. Drywall or sheetrock has an excellent bass resonance that amazes most listeners.

While the principals of the invention have been made clear in illustrative embodiments, it will be immediately obvious to those skilled in the art that many modifications of structure, arrangement, proportions, the elements, materials, and components used in the practice of this invention, and otherwise, which are particularly adapted to specific environments and operative requirements can be made without departing from those principles. The following claims are intended to cover and embrace any or all of such modifications, within the limits of the true spirit and scope of the invention.

What I claim is:

1. A transducer apparatus with means for transmitting electromagnetic sound signals to a vibratory receiving means and with means for transmitting said received signals to a surrounding area, whereby said transducer means has driving means and driven means, with said driving means and said driven means being coupled together in a spaced relationship by a resilient compressible and expandable means with adjustable magnetizable bumper interposed between said driving means and said driven means that allows open separation of said driving means and said driven means about bumper means when said transducer apparatus is activated by a varying electrical signal, whereby vibratory transfer means are attached to the flanges of a magnetizable vented cup shaped baffling structure and extends over the open space of said magnetizable vented cup shaped structure of said magnetically driven means and interposed between said magnetically driven means and a vibratory receiving means with means for attaching said vibratory transfer means to said vibratory receiving means.

2. A transducer apparatus having a magnetic driving means and a magnetically driven means with said driven means consisting of a magnetizable vented cup shaped baffling structure with flanges extending outwardly from the rim of said magnetizable vented cup shaped baffling portion of said driven element, with said driving means and said driven means resiliently coupled together in a spaced relationship with said driven means having flanges affixed to a vibratory receiving means with fastening means wherein said magnetizable vented cup shaped baffling portion of said driven means is in a spaced relationship with the vibratory receiving means and said vented cup baffling portion of said driven means, when activated with a varying magnetic signal can oscillate and is not in direct contact with said vibratory receiving means, whereby said flanges are an integral part of said driven means and are in solid vibratory contact with said vibratory receiving means, transfers a portion of the magnetically driven force applied from said driven means to said vibratory receiving means, and the other portion that said vibratory receiving means is unable to react to, because of its weight, is radiated to a surrounding area.

3. A transducer apparatus according to claim 2, whereby vibratory transfer means are attached to said flanges and extend over said open space of the magnetizable vented cup shape portion of said magnetically driven means and interposed between said magnetically driven means and said vibratory receiving means with means for attaching said vibratory transfer means to said vibratory receiving means.

4. A transducer apparatus according to claim 1, comprising a driving means and a driven means with an opening provided through said driving means for the movement of air through and away from said driving means, whereby said air movement is generated by the vibratory movement of said driven means.

5. A transducer apparatus according to claim 2, comprising a driving means and a driven means with an opening provided through said driving means for the movement of air through and away from said driving means, whereby said air movement is generated by the vibratory movement of said driven means.

* * * * *